US008669035B2

(12) United States Patent
Sun et al.

(10) Patent No.: US 8,669,035 B2
(45) **Date of Patent: *Mar. 11, 2014**

(54) PROCESS FOR PREPARING TONER INCLUDING A BORAX COUPLING AGENT

(75) Inventors: Jing X. Sun, Lexington, KY (US); Kofi Opare Diggs, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 86 days.

This patent is subject to a terminal disclaimer.

(21) Appl. No.: 13/339,565

(22) Filed: Dec. 29, 2011

(65) Prior Publication Data

US 2013/0171551 A1 Jul. 4, 2013

(51) Int. Cl.
*G03G 9/08* (2006.01)

(52) U.S. Cl.
USPC ..... 430/137.14; 430/137.15; 430/110.2; 430/108.1; 430/109.4

(58) Field of Classification Search
USPC ..... 430/137.14, 137.15, 110.2, 108.1, 430/109.4
See application file for complete search history.

(56) References Cited

U.S. PATENT DOCUMENTS

| | | | |
|---|---|---|---|
| 5,073,469 | A | 12/1991 | Diaz |
| 6,331,372 | B1 | 12/2001 | Livengood |
| 6,492,083 | B1 | 12/2002 | Livengood |
| 6,531,254 | B1 | 3/2003 | Bedells |
| 6,531,256 | B1 | 3/2003 | Bedells |
| 6,534,230 | B1 | 3/2003 | Blair |
| 6,991,884 | B2 | 1/2006 | Sun |
| 7,435,523 | B2 | 10/2008 | Olson |
| 7,504,189 | B2 | 3/2009 | Sun |
| 7,510,812 | B2 | 3/2009 | Earley |
| 7,695,882 | B2 | 4/2010 | Broce |
| 7,897,318 | B2 | 3/2011 | Peter |
| 7,923,191 | B2 | 4/2011 | Bertelsen |
| 7,939,236 | B2 | 5/2011 | Beach |
| 2009/0087765 | A1 | 4/2009 | Kidokoro |
| 2009/0155705 | A1 | 6/2009 | Jones |
| 2010/0062359 | A1 | 3/2010 | Bensing |
| 2011/0003242 | A1 | 1/2011 | Hayashi |
| 2012/0052430 | A1 | 3/2012 | Yamasaki et al. |

*Primary Examiner* — Mark A Chapman

(57) ABSTRACT

A method for producing toner according to one example embodiment includes combining and agglomerating a first polymer emulsion with a colorant dispersion and a release agent dispersion to form toner cores. A borax coupling agent is added to the toner cores. A second polymer emulsion is combined and agglomerated with the toner cores having the borax coupling agent to form toner shells around the toner cores. The aggregated toner cores and toner shells are fused to form toner particles.

20 Claims, 2 Drawing Sheets

PROCESS FOR PREPARING TONER INCLUDING A BORAX COUPLING AGENT

CROSS REFERENCES TO RELATED APPLICATIONS

This patent application is related to U.S. patent application Ser. No. 13/339,705, filed Dec. 29, 2011, entitled "Chemically Prepared Toner Formulation including a Borax Coupling Agent", and assigned to the assignee of the present application.

BACKGROUND

1. Field of the Disclosure

The present invention relates generally to processes for chemically preparing to toner for use in electrophotography and more particularly to a process for chemically preparing toner including a borax coupling agent.

2. Description of the Related Art

Toners for use in electrophotographic printers include two primary types, mechanically milled toners and chemically prepared toners (CPT). Chemically prepared toners have significant advantages over mechanically milled toners including better print quality, higher toner transfer efficiency and lower torque properties for various components of the electrophotographic printer such as a developer roller, a fuser belt and a charge roller. The particle size distribution of CPTs is typically narrower than the particle size distribution of mechanically milled toners. The size and shape of CPTs are also easier to control than mechanically milled toners.

There are several known types of CPT including suspension polymerization toner (SPT), emulsion aggregation toner (EAT)/latex aggregation toner (LAT), toner made from a dispersion of pre-formed polymer in solvent (DPPT) and "chemically milled" toner. While emulsion aggregation toner requires a more complex process than other CPTs, the resulting toner has a relatively narrower size distribution. Emulsion aggregation toners can also be manufactured with a smaller particle size allowing improved print resolution. The emulsion aggregation process also permits better control of the shape and structure of the toner particles which allows them to be tailored to fit the desired cleaning, doctoring and transfer properties. The shape of the toner particles may be optimized to ensure proper and efficient cleaning of the toner from various electrophotographic printer components, such as the developer roller, charge roller and doctoring blades, in order to prevent filming or unwanted deposition of toner on these components.

In a typical process for preparing EAT, emulsion aggregation is carried out in an aqueous system resulting in good control of both the size and shape of the toner particles. The toner components typically include a polymer binder, one or more colorants and a release agent. A styrene-acrylic copolymer polymer binder is often used as the latex binder in the emulsion aggregation process. However, the use of a styrene-acrylic copolymer latex binder requires a tradeoff between the toner's fusing properties and its shipping and storage properties. A toner's fusing properties include its fuse window. The fuse window is the range of temperatures at which fusing is satisfactorily conducted without incomplete fusion and without transfer of toner to the heating element, which may be a roller, belt or other member contacting the toner during fusing. Thus, below the low end of the fuse window the toner is incompletely melted and above the high end of the fuse window the toner flows onto the fixing member where it mars subsequent sheets being fixed. It is preferred that the low end of the fuse window be as low as possible to reduce the required temperature of the fuser in the electrophotographic printer to improve the printer's safety and to conserve energy. However, the toner must also be able to survive the temperature and humidity extremes associated with storage and shipping without caking or blocking which may result in print flaws. As a result, the low end of the fuse window cannot be so low that the toner could melt during the storing or shipping of a toner cartridge containing the toner.

Toners formed from polyester binder resins typically possess better mechanical properties than toners formed from a styrene-acrylic copolymer binder of similar melt viscosity characteristics. This makes them more durable and resistant to filming of printer components. Polyester toners also have better compatibility with color pigments resulting in a wider color gamut. Until recently, polyester binder resins were frequently used in preparing mechanically milled toners but rarely in chemically prepared toners. Polyester binder resins are manufactured using condensation polymerization. This method is time consuming due to the involvement of long polymerization cycles and therefore limits the use of polyester binder resins to polyester polymers having low to moderate molecular weights, which limits the fusing properties of the toner. Further, polyester binder resins are more difficult to disperse in an aqueous system due to their polar nature, pH sensitivity and gel content thereby limiting their applicability in the emulsion aggregation process.

However, with advancement in toner manufacturing technology, it has become possible to obtain stable emulsions formed using polyester binder resins by first dissolving them in an organic solvent, such as methyl ethyl ketone (MEK), methylene chloride, ethyl acetate, or tetrahydrofuran (THF), and then performing a phase-inversion process where water is added slowly to the organic solvent. The organic solvent is then evaporated to allow the polyester binder resins to form stable emulsions. U.S. Pat. No. 7,939,236 entitled "Chemically Prepared Toner and Process Therefor," which is assigned to the assignee of the present application and incorporated by reference herein in its entirety, teaches a similar process for obtaining a stable emulsion using an organic solvent. These advances have permitted the use of polyester binder resins to form emulsion aggregation toner. For example, U.S. Pat. No. 7,923,191 entitled "Polyester Resin Produced by Emulsion Aggregation" and U.S. patent application Ser. No. 12/206,402 entitled "Emulsion Aggregation Toner Formulation," which are assigned to the assignee of the present application and incorporated by reference herein in their entirety, disclose processes for preparing emulsion aggregation toner using polyester binder resins.

These techniques provide the ability to produce emulsion aggregation toner that possesses excellent fusibility; however, issues related to surface migration of lower molecular weight resins, waxes and colorants persist. The migration of these ingredients to the surface of the toner particle weakens the toner's fusing and ship/store properties and increases the occurrence of filming on printer components. Accordingly, it will be appreciated that an emulsion aggregation toner formulation and process that reduces the migration of lower molecular weight resins, waxes and colorants to the toner particle surface is desired. It is also desired to minimize the overall number of fine toner particles, which contribute to filming on the printer components.

SUMMARY

A method for producing toner according to a first example embodiment includes combining and agglomerating a first polymer emulsion with a colorant dispersion and a release agent dispersion to form toner cores. A borax coupling agent is added to the toner cores. A second polymer emulsion is combined and agglomerated with the toner cores having the borax coupling agent to form toner shells around the toner cores. The aggregated toner cores and toner shells are fused to form toner particles.

A method for producing toner according to a second example embodiment includes combining a first polymer emulsion with a colorant dispersion and a release agent dispersion to form toner cores. The pH of the combination of the first polymer emulsion, the colorant dispersion and the release agent dispersion is adjusted to promote agglomeration of the toner cores. Once the toner cores reach a predetermined size, a borax coupling agent is added to the toner cores. A second polymer emulsion is combined with the toner cores having the borax coupling agent forming toner shells around the toner cores. Once a desired toner particle size is reached, the pH of the mixture of aggregated toner cores and toner shells is adjusted to prevent additional particle growth. The aggregated toner cores and toner shells are fused to form toner particles.

BRIEF DESCRIPTION OF THE DRAWINGS

The above-mentioned and other features and advantages of the various embodiments, and the manner of attaining them, will become more apparent and will be better understood by reference to the accompanying drawings.

DETAILED DESCRIPTION

Figure 1:
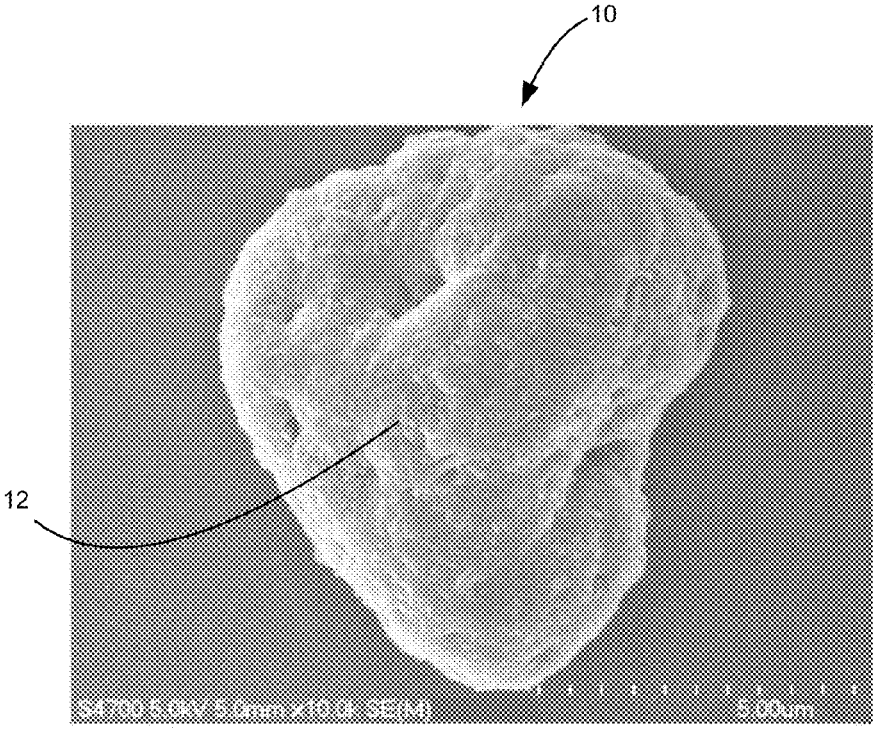
Figure 1 PRIOR ART
FIG. 1 is an image of a conventional emulsion aggregation toner particle taken using a scanning electron microscope.

The following description and drawings illustrate embodiments sufficiently to enable those skilled in the art to practice the present invention. It is to be understood that the disclosure is not limited to the details of construction and the arrangement of components set forth in the following description or illustrated in the drawings. The invention is capable of other embodiments and of being practiced or of being carried out in various ways. For example, other embodiments may incorporate structural, chronological, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense and the scope of the present invention is defined by the appended claims. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The present disclosure relates to a chemically prepared toner containing a borax coupling agent between core and shell layers of the toner and an associated emulsion aggregation method of preparation. The toner may be utilized in an electrophotographic printer such as a printer, copier, multifunction device or an all-in-one device. The toner may be provided in a cartridge that supplies toner to the electrophotographic printer. Example methods of forming toner using conventional emulsion aggregation techniques may be found in U.S. Pat. Nos. 6,531,254 and 6,531,256, which are incorporated by reference herein in their entirety.

In the present emulsion aggregation process, the toner particles are provided by chemical methods as opposed to physical methods such as pulverization. Generally, the toner includes one or more polymer binders, a release agent, a colorant, a borax coupling agent and one or more optional additives such as a charge control agent (CCA). An emulsion of a polymer binder is formed in water, optionally with organic solvent, with an inorganic base such as sodium hydroxide, potassium hydroxide, ammonium hydroxide, or an organic amine compound. A stabilizing agent having an anionic functional group (A−), e.g., an anionic surfactant or an anionic polymeric dispersant may also be included. It will be appreciated that a cationic (C+) functional group, e.g., a cationic surfactant or a cationic polymeric dispersant, may be substituted as desired. The polymer latex is used at two points during the toner formation process. A first portion of the polymer latex is used to form the core of the resulting toner particle and a second portion of the polymer latex is used to form a shell around the toner core. The first and second portions of the polymer latex may be formed separately or together. Where the portions of the polymer latex forming the toner core and the toner shell are formed separately, either the same or different polymer binders may be used. The ratio of the amount of polymer binder in the toner core to the amount of toner in the shell is between about 20:80 (wt.) and about 80:20 (wt.) including all values and increments therebetween, such as between about 50:50 (wt.) and about 80:20 (wt.), depending on the particular resin(s) used.

The colorant, release agent, and the optional CCA are dispersed separately in their own aqueous environments or in one aqueous mixture, as desired, in the presence of a stabilizing agent having similar functionality (and ionic charge) as the stabilizing agent employed in the polymer latex. The polymer latex forming the toner core, the release agent dispersion, the colorant dispersion and the optional CCA dispersion are then mixed and stirred to ensure a homogenous composition. As used herein, the term dispersion refers to a system in which particles are dispersed in a continuous phase of a different composition (or state) and may include an emulsion. Acid is then added to reduce the pH and cause flocculation. Flocculation refers to the process by which destabilized particles conglomerate (due to e.g., the presence of available counterions) into relatively larger aggregates. In this case, flocculation includes the formation of a gel where resin, colorant, release agent and CCA form an aggregate mixture, typically from particles 1-2 microns (μm) in size. Unless stated otherwise, reference to particle size herein refers to the largest cross-sectional dimension of the particle. The aggregated toner particles may then be heated to a temperature that is less than or around (e.g., ±5° C.) the glass transition temperature (Tg) of the polymer latex to induce the growth of clusters of the aggregate particles. Once the aggregate particles reach the desired size of the toner core, the borax coupling agent is added so that it forms on the surface of the toner core. Following addition of the borax coupling agent, the polymer latex forming the toner shell is added. This polymer latex aggregates around the toner core to form the toner shell. Once the aggregate particles reach the desired toner size, base may be added to increase the pH and reionize the anionic stabilizing agent to prevent further particle growth or one can add additional anionic stabilizing agents. The temperature is then raised above the glass transition temperature of the polymer latex(es) to fuse the particles together within each cluster. This temperature is maintained until the particles reach the desired circularity. The toner particles are then washed and dried.

The toner particles produced may have an average particle size of between about 3 μm and about 20 μm (volume average particle size) including all values and increments therebetween, such as between about 4 μm and about 15 μm or, more particularly, between about 5 μm and about 7 μm. The toner particles produced may have an average degree of circularity between about 0.90 and about 1.00, including all values and increments therebetween, such as about 0.93 to about 0.98. The average degree of circularity and average particle size may be determined by a Sysmex Flow Particle Image Analyzer (e.g., FPIA-3000) available from Malvern Instruments.

The various components for the emulsion aggregation method to prepare the above referenced toner will be described below. It should be noted that the various features of the indicated components may all be adjusted to facilitate the step of aggregation and formation of toner particles of desired size and geometry. It may therefore be appreciated that by controlling the indicated characteristics, one may first form relatively stable dispersions, wherein aggregation may proceed along with relatively easy control of final toner particle size for use in an electrophotographic printer or printer cartridge.

Polymer Binder

As mentioned above, the toners herein include one or more polymer binders. The terms resin and polymer are used interchangeably herein as there is no technical difference between the two. In one embodiment, the polymer binder(s) include polyesters. The polyester binder(s) may include a semi-crystalline polyester binder, a crystalline polyester binder or an amorphous polyester binder. Alternatively, the polyester binder(s) may include a polyester copolymer binder resin. For example, the polyester binder(s) may include a styrene/acrylic-polyester graft copolymer. The polyester binder(s) may be formed using acid monomers such as terephthalic acid, trimellitic anhydride, dodecenyl succinic anhydride and fumaric acid. Further, the polyester binder(s) may be formed using alcohol monomers such as ethoxylated and propoxylated bisphenol A. Example polyester resins include, but are not limited to, T100, TF-104, NE-1582, NE-701, NE-2141, NE-1569, Binder C, FPESL-2, W-85N, TL-17, TPESL-10, TPESL-11 polyester resins from Kao Corporation, Bunka Sumida-ku, Tokyo, Japan, or mixtures thereof.

In other embodiments, the polymer binder(s) include a thermoplastic type polymer such as a styrene and/or substituted styrene polymer, such as a homopolymer (e.g., polystyrene) and/or copolymer (e.g., styrene-butadiene copolymer and/or styrene-acrylic copolymer, a styrene-butyl methacrylate copolymer and/or polymers made from styrene-butyl acrylate and other acrylic monomers such as hydroxy acrylates or hydroxyl methacrylates); polyvinyl acetate, polyalkenes, poly(vinyl chloride), polyurethanes, polyamides, silicones, epoxy resins, or phenolic resins.

As discussed above, in some embodiments, the toner core may be formed from one polymer binder (or mixture) and the toner shell formed from another. Further, the ratio of the amount of polymer binder in the toner core to the amount of toner in the toner shell may be between about 20:80 (wt.) and about 80:20 (wt.) or more specifically between about 50:50 (wt.) and about 80:20 (wt.) including all values and increments therebetween. The total polymer binder may be provided in the range of about 70% to about 95% by weight of the final toner formulation including all values and increments therebetween.

Borax Coupling Agent

The coupling agent used herein is borax (also known as sodium borate, sodium tetraborate, or disodium tetraborate). As used herein the term coupling agent refers to a chemical compound having the cross-linking ability to bond two or more components together. Typically, coupling agents have multivalent bonding ability. Borax differs from commonly used permanent coupling agents, such as multivalent metal ions (e.g., aluminum and zinc), in that its bonding is reversible. In the electrophotographic process, toner is preferred to have a low fusing temperature to save energy and a low melt viscosity ("soft") to permit high speed printing at low fusing temperatures. However, in order to maintain the stability of the toner during shipping and storage and to prevent filming of the printer components, toner is preferred to be "harder" at temperatures below the fusing temperature. Borax provides cross-linking through hydrogen bonding between its hydroxy groups and the functional groups of the molecules it is bonded to. The hydrogen bonding is sensitive to temperature and pressure and is not a stable and permanent bond. For example, when the temperature is increased to a certain degree or stress is applied to the polymer, the bond will partially or completely break causing the polymer to "flow" or tear off. The reversibility of the bonds formed by the borax coupling agent is particularly useful in toner because it permits a "soft" toner at the fusing temperature but a "hard" toner at the storage temperature.

It has also been observed that borax surprisingly causes fine particles to collect on larger particles. As a result, borax is particularly suitable as a coupling agent between the core and shell layers of the toner because it collects the components of the toner core to the core particle before the shell is added thereby reducing the residual fine particles in the toner. This, in turn, reduces the amount of acid needed in the agglomeration stage and narrows the particle size distribution of the toner.

Borax also serves as a good buffer in the toner formation reaction as a result of the equilibrium formed by its boric acid and conjugate base. The presence of borax makes the reaction more resistant to pH changes and broadens the pH adjusting window of the reaction in comparison with a conventional emulsion aggregation process. The pH adjusting window is crucial in the industrial scale up of the process to control the particle size. With a broader window, the process is easier to control at an industrial scale.

The quantity of the borax coupling agent used herein can be varied. The borax coupling agent may be provided at between about 0.1% and about 5.0% by weight of the total polymer binder in the toner including all values and increments therebetween, such as between about 0.1% and about 1.0% or between about 0.1% and about 0.5%. If too much coupling agent is used, its bonding may not be completely broken at high temperature fusing. On the other hand, if too little coupling agent is used, it may fail to provide the desired bonding and buffering effects.

Colorant

Colorants are compositions that impart color or other visual effects to the toner and may include carbon black, dyes (which may be soluble in a given medium and capable of precipitation), pigments (which may be insoluble in a given medium) or a combination of the two. A colorant dispersion may be prepared by mixing the pigment in water with a dispersant. Alternatively, a self-dispersing colorant may be used thereby permitting omission of the dispersant. The colorant may be present in the dispersion at a level of about 5% to about 20% by weight including all values and increments therebetween. For example, the colorant may be present in the dispersion at a level of about 10% to about 15% by weight. The dispersion of colorant may contain particles at a size of about 50 nanometers (nm) to about 500 nm including all values and increments therebetween. Further, the colorant dispersion may have a pigment weight percent divided by dispersant weight percent (P/D ratio) of about 1:1 to about 8:1 including all values and increments therebetween, such as about 2:1 to about 5:1. The colorant may be present at less than or equal to about 15% by weight of the final toner formulation including all values and increments therebetween.

Release Agent

The release agent may include any compound that facilitates the release of toner from a component in an electrophotographic printer (e.g., release from a roller surface). For example, the release agent may include polyolefin wax, ester wax, polyester wax, polyethylene wax, metal salts of fatty acids, fatty acid esters, partially saponified fatty acid esters, higher fatty acid esters, higher alcohols, paraffin wax, carnauba wax, amide waxes and polyhydric alcohol esters.

The release agent may therefore include a low molecular weight hydrocarbon based polymer (e.g., Mn≤10,000) having a melting point of less than about 140° C. including all values and increments between about 50° C. and about 140° C. For example, the release agent may have a melting point of about 60° C. to about 135° C., or from about 65° C. to about 100° C., etc. The release agent may be present in the dispersion at an amount of about 5% to about 35% by weight including all values and increments therebetween. For example, the release agent may be present in the dispersion at an amount of about 10% to about 18% by weight. The dispersion of release agent may also contain particles at a size of about 50 nm to about 1 μm including all values and increments therebetween. In addition, the release agent dispersion may be further characterized as having a release agent weight percent divided by dispersant weight percent (RA/D ratio) of about 1:1 to about 30:1. For example, the RA/D ratio may be about 3:1 to about 8:1. The release agent may be provided in the range of about 2% to about 20% by weight of the final toner formulation including all values and increments therebetween.

Surfactant/Dispersant

A surfactant, a polymeric dispersant or a combination thereof may be used. The polymeric dispersant may generally include three components, namely, a hydrophilic component, a hydrophobic component and a protective colloid component. Reference to hydrophobic refers to a relatively non-polar type chemical structure that tends to self-associate in the presence of water. The hydrophobic component of the polymeric dispersant may include electron-rich functional groups or long chain hydrocarbons. Such functional groups are known to exhibit strong interaction and/or adsorption properties with respect to particle surfaces such as the colorant and the polyester binder resin of the polyester resin emulsion. Hydrophilic functionality refers to relatively polar functionality (e.g., an anionic group) which may then tend to associate with water molecules. The protective colloid component includes a water soluble group with no ionic function. The protective colloid component of the polymeric dispersant provides extra stability in addition to the hydrophilic component in an aqueous system. Use of the protective colloid component substantially reduces the amount of the ionic monomer segment or the hydrophilic component in the polymeric dispersant. Further, the protective colloid component stabilizes the polymeric dispersant in lower acidic media. The protective colloid component generally includes polyethylene glycol (PEG) groups. The dispersant employed herein may include the dispersants disclosed in U.S. Pat. No. 6,991,884 and U.S. Pat. No. 5,714,538, which are incorporated by reference herein in their entirety.

The surfactant, as used herein, may be a conventional surfactant known in the art for dispersing non self-dispersing colorants and release agents employed for preparing toner formulations for electrophotography. Commercial surfactants such as the AKYPO series of carboxylic acids from AKYPO from Kao Corporation, Bunka Sumida-ku, Tokyo, Japan may be used. For example, alkyl ether carboxylates and alkyl ether sulfates, preferably lauryl ether carboxylates and lauryl ether sulfates, respectively, may be used. One particular suitable anionic surfactant is AKYPO RLM-100 available from Kao Corporation, Bunka Sumida-ku, Tokyo, Japan, which is laureth-11 carboxylic acid thereby providing anionic carboxylate functionality. Other anionic surfactants contemplated herein include alkyl phosphates, alkyl sulfonates and alkyl benzene sulfonates. Sulfonic acid containing polymers or surfactants may also be employed.

Optional Additives

The toner formulation of the present disclosure may also include one or more conventional charge control agents, which may optionally be used for preparing the toner formulation. A charge control agent may be understood as a compound that assists in the production and stability of a tribocharge in the toner. The charge control agent(s) also help in preventing deterioration of charge properties of the toner formulation. The charge control agent(s) may be prepared in the form of a dispersion in a manner similar to that of the colorant and release agent dispersions discussed above.

The toner formulation may include one or more additional additives, such as acids and/or bases, emulsifiers, UV absorbers, fluorescent additives, pearlescent additives, plasticizers and combinations thereof. These additives may be desired to enhance the properties of an image printed using the present toner formulation. For example, UV absorbers may be included to increase UV light fade resistance by preventing gradual fading of the image upon subsequent exposures to ultraviolet radiations. Suitable examples of the UV absorbers include, but are not limited to, benzophenone, benzotriazole, acetanilide, triazine and derivatives thereof. Commercial plasticizers that are known in the art may also be used to adjust the coalescening temperature of the toner formulation.

The following examples are provided to further illustrate the teachings of the present disclosure, not to limit the scope of the present disclosure.

EXAMPLES

Example Magenta Pigment Dispersion

About 10 g of AKYPO RLM-100 polyoxyethylene(10) lauryl ether carboxylic acid from Kao Corporation, Bunka Sumida-ku, Tokyo, Japan was combined with about 350 g of de-ionized water and the pH was adjusted to ~7-9 using sodium hydroxide. About 10 g of Solsperse 27000 from Lubrizol Advanced Materials, Cleveland, Ohio, USA was added and the dispersant and water mixture was blended with an electrical stirrer followed by the relatively slow addition of 100 g of red 122 pigment. Once the pigment was completely wetted and dispersed, the mixture was added to a horizontal media mill to reduce the particle size. The solution was processed in the media mill until the particle size was about 200 nm. The final pigment dispersion was set to contain about 20% to about 25% solids by weight.

Example Cyan Pigment Dispersion

About 10 g of AKYPO RLM-100 polyoxyethylene(10) lauryl ether carboxylic acid from Kao Corporation, Bunka Sumida-ku, Tokyo, Japan was combined with about 350 g of de-ionized water and the pH was adjusted to ~7-9 using sodium hydroxide. About 10 g of Solsperse 27000 from Lubrizol Advanced Materials, Cleveland, Ohio, USA was added and the dispersant and water mixture was blended with an electrical stirrer followed by the relatively slow addition of 100 g of pigment blue 15:3. Once the pigment was completely wetted and dispersed, the mixture was added to a horizontal media mill to reduce the particle size. The solution was processed in the media mill until the particle size was about 200 nm. The final pigment dispersion was set to contain about 20% to about 25% solids by weight.

Example Wax Emulsion

About 12 g of AKYPO RLM-100 polyoxyethylene(10) lauryl ether carboxylic acid from Kao Corporation, Bunka Sumida-ku, Tokyo, Japan was combined with about 325 g of de-ionized water and the pH was adjusted to ~7-9 using sodium hydroxide. The mixture was then processed through a microfluidizer and heated to about 90° C. About 60 g of polyethylene wax from Petrolite, Corp., Westlake, Ohio, USA was slowly added while the temperature was maintained at about 90° C. for about 15 minutes. The emulsion was then removed from the microfluidizer when the particle size was below about 300 nm. The solution was then stirred at room temperature. The wax emulsion was set to contain about 10% to about 18% solids by weight.

Example Polyester Resin Emulsion A

A mixed polyester resin having a peak molecular weight of about 9,000, a glass transition temperature (Tg) of about 53° C. to about 58° C., a melt temperature (Tm) of about 110° C., and an acid value of about 15 to about 20 was used. The glass transition temperature is measured by differential scanning calorimetry (DSC), wherein, in this case, the onset of the shift in baseline (heat capacity) thereby indicates that the Tg may occur at about 53° C. to about 58° C. at a heating rate of about 5 per minute. The acid value may be due to the presence of one or more free carboxylic acid functionalities (—COOH) in the polyester. Acid value refers to the mass of potassium hydroxide (KOH) in milligrams that is required to neutralize one gram of the polyester. The acid value is therefore a measure of the amount of carboxylic acid groups in the polyester.

150 g of the mixed polyester resin was dissolved in 450 g of methyl ethyl ketone (MEK) in a round bottom flask with stiffing. The dissolved resin was then poured into a beaker. The beaker was placed in an ice bath directly under a homogenizer. The homogenizer was turned on at high shear and 10 g of 10% potassium hydroxide (KOH) solution and 500 g of de-ionized water were immediately added to the beaker. The homogenizer was run at high shear for about 2-4 minutes then the homogenized resin solution was placed in a vacuum distillation reactor. The reactor temperature was maintained at about 43° C. and the pressure was maintained between about 22 inHg and about 23 inHg. About 500 mL of additional de-ionized water was added to the reactor and the temperature was gradually increased to about 70° C. to ensure that substantially all of the MEK was distilled out. The heat to the reactor was then turned off and the mixture was stirred until it reached room temperature. Once the reactor reached room temperature, the vacuum was turned off and the resin solution was removed and placed in storage bottles.

The particle size of the resin emulsion was between about 185 nm and about 235 nm (volume average) as measured by a NANOTRAC Particle Size Analyzer. The pH of the resin solution was between about 6.5 and about 7.0.

Example Polyester Resin Emulsion B

A polyester resin having a peak molecular weight of about 11,000, a glass transition temperature of about 55° C. to about 60° C., a melt temperature of about 110° C., and an acid value of about 15 to about 20 was used to form an emulsion using the procedure described in Example Polyester Resin A, except using 8 g of the 10% potassium hydroxide (KOH) solution.

The particle size of the resin emulsion was between about 195 nm and about 235 nm (volume average) as measured by a NANOTRAC Particle Size Analyzer. The pH of the resin solution was between about 6.7 and about 7.2.

Example Polyester Resin Emulsion C

A polyester resin having a peak molecular weight of about 11,000, a glass transition temperature of about 55° C. to about 58° C., a melt temperature of about 115° C., and an acid value of about 8 to about 13 was used to form an emulsion using the procedure described in Example Polyester Resin A, except using 7 g of the 10% potassium hydroxide (KOH) solution.

The particle size of the resin emulsion was between about 190 nm and about 240 nm (volume average) as measured by a NANOTRAC Particle Size Analyzer. The pH of the resin solution was between about 7.5 and about 8.2.

Toner Formulation Examples

Comparative Example Toner I

Comparative Example Toner I was prepared using a conventional emulsion aggregation process and did not include a borax coupling agent. The emulsion aggregation CPT used in this example was an acid agglomeration with a pH reversal used to stop the growth of the toner particles. Components were added to a 2.5 liter reactor in the following relative proportions: 88.2 parts (polyester by weight) of the Example Polyester Resin Emulsion A, 6.8 parts (pigment by weight) of the Example Magenta Pigment Dispersion, and 5 parts (release agent by weight) of the Example Wax Emulsion. Deionized water was then added so that the mixture contained about 12.5% solids by weight.

The mixture was heated in the reactor to 30° C. and a circulation loop was started consisting of a high shear mixer and an acid addition pump. The mixture was sent through the loop and the high shear mixer was set at 10,000 revolutions per minute (rpm). Acid was slowly added to the high shear mixer to evenly disperse the acid in the toner mixture so that there were no pockets of low pH. Acid addition took about 4 minutes using 306 g of 1% sulfuric acid solution. The flow of the loop was then reversed to return the toner mixture to the reactor. The reactor temperature was increased to about 50° C. to grow the particles. The temperature was held around 50° C. until the particles reached the desired size (number average size of about 5 μm to about 6 μm and volume average size of about 6 μm to about 7 μm). Once the particles reached their desired size, 4% NaOH was added to raise the pH to 6.00 to stop the particle growth. The reaction was held at about 50° C. for about an hour and then the temperature was increased to 91° C. to cause the particles to coalesce. The particles were held at 91° C. until the particles reached the desired circularity (about 0.97). The toner was then washed and dried.

The dried toner had a volume average particle size of 6.0 μm, measured by a COULTER COUNTER Multisizer 3 analyzer. Fines (<2 μm) were present at 4.16% (by number) and the toner possessed a circularity of 0.970, both measured by the SYSMEX FPIA-3000 particle characterization analyzer, manufactured by Malvern Instruments, Ltd., Malvern, Worcestershire UK. The amount of fines in Comparative Example Toner I was consistent with other emulsion aggregation polyester toners that did not include a borax coupling agent, which possessed fines between 1% and 7% (by number).

Additional toners were made using the formulation and procedure from the Comparative Example Toner I, except the neutralization pH was altered to test the pH adjusting window. The results of these toners are shown in Table 2 below.

Example Toner A

The Example Polyester Resin Emulsion A was divided into two batches, split 70:30 by weight to form the core and the shell of the toner, respectively. The total polyester content represented about 87.7% of the total toner solids. Accordingly, the first batch contained 61.4% of the total toner solids and the second batch contained 26.3% of the total toner solids. Components were added to a 2.5 liter reactor in the following percentages: the first batch of the Example Polyester Resin Emulsion A having 61.4 parts (polyester by weight), 6.8 parts (pigment by weight) of the Example Magenta Pigment Dispersion, and 5 parts (release agent by weight) of the Example Wax Emulsion. Deionized water was then added so that the mixture contained about 12% to about 15% solids by weight.

The mixture was heated in the reactor to 30° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 200 g of 1% sulfuric acid solution. The flow of the loop was then reversed to return the toner mixture to the reactor and the temperature of the reactor was increased to about 40-45° C. Once the particle size reached 4.0 μm (number average), 5% (wt.) borax solution (30 g of solution having 1.5 g of borax) was added. The borax content represented about 0.5% by weight of the total toner solids. After the addition of borax, the second batch of the Example Polyester Resin Emulsion A was added, which contained 26.3 parts (polyester by weight). The mixture was stirred for about 5 minutes and the pH was monitored. Once the particle size reached 5.5 μm (number average), 4% NaOH was added to raise the pH to about 5.95 to stop the particle growth. The reaction temperature was held for one hour. The particle size was monitored during this time period. Once particle growth stopped, the temperature was increased to 88° C. to cause the particles to coalesce. This temperature was maintained until the particles reached their desired circularity (about 0.97). The toner was then washed and dried.

The dried toner had a volume average particle size of 6.65 μm and a number average particle size of 5.49 μm. Fines (<2 μm) were present at 0.11% (by number) and the toner possessed a circularity of 0.978.

Additional toners were made using the formulation and procedure from the Example Toner A, except the neutralization pH was altered to test the pH adjusting window. The results of these toners are shown in Table 2 below.

Example Toner B

The Example Polyester Resin Emulsion A was divided into two batches, split 60:40 by weight to form the core and the shell of the toner, respectively. The total polyester content represented about 87.9% of the total toner solids. Accordingly, the first batch contained 52.7% of the total toner solids and the second batch contained 35.2% of the total toner solids. Components were added to a 2.5 liter reactor in the following percentages: the first batch of the Example Polyester Resin Emulsion A having 52.7 parts (polyester by weight), 6.8 parts (pigment by weight) of the Example Magenta Pigment Dispersion and 5 parts (release agent by weight) of the Example Wax Emulsion. Deionized water was then added so that the mixture contained about 12% to about 15% solids by weight.

The mixture was heated in the reactor to 30° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 150 g of 1% sulfuric acid solution. The flow of the loop was then reversed to return the toner mixture to the reactor and the temperature of the reactor was increased to about 40-45° C. Once the particle size reached 4.0 μm (number average), 5% borax solution (15 g of solution having 0.75 g borax) was added. The borax content represented about 0.3% by weight of the total toner solids. After the addition of borax, the second batch of the Example Polyester Resin Emulsion A was added, which contained 35.2 parts (polyester by weight). The mixture was stirred for about 5 minutes and the pH was monitored. Once the particle size reached 5.5 μm (number average), 4% NaOH was added to raise the pH to about 5.95 to stop the particle growth. The reaction temperature was held for one hour. The particle size was monitored during this time period. Once particle growth stopped, the temperature was increased to 88° C. to cause the particles to coalesce. This temperature was maintained until the particles reached their desired circularity (about 0.97). The toner was then washed and dried.

The dried toner had a volume average particle size of 6.24 μm and a number average particle size of 5.48 μm. Fines (<2 μm) were present at 0.09% (by number) and the toner possessed a circularity of 0.983.

Example Toner C

A combination of Example Polyester Resin Emulsion A and Example Polyester Resin Emulsion C was used in a 70:30 ratio by weight to form the core and the shell of the toner, respectively. The total polyester content represented about 87.9% of the total toner solids. Accordingly, Example Polyester Resin Emulsion A contained 61.5% of the total toner solids and Example Polyester Resin Emulsion C contained 26.4% of the total toner solids. Components were added to a 2.5 liter reactor in the following percentages: Example Polyester Resin Emulsion A having 61.5 parts (polyester by weight), 6.8 parts (pigment by weight) of the Example Magenta Pigment Dispersion and 5 parts (release agent by weight) of the Example Wax Emulsion. Deionized water was then added so that the mixture contained about 12% to about 15% solids by weight.

The mixture was heated in the reactor to 30° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 200 g of 1% sulfuric acid solution. The flow of the loop was then reversed to return the toner mixture to the reactor and the temperature of the reactor was increased to about 37-42° C. Once the particle size reached 4.0 μm (number average), 5% (wt.) borax solution (15 g of solution having 0.75 g of borax) was added. The borax content represented about 0.25% by weight of the total toner solids. After the addition of borax, the Example Polyester Resin Emulsion C was added, which contained 26.4 parts (polyester by weight). The mixture was stirred for about 5 minutes and the pH was monitored. Once the particle size reached 5.5 μm (number average), 4% NaOH was added to raise the pH to about 6.60 to stop the particle growth. The reaction temperature was held for one hour. The particle size was monitored during this time period. Once particle growth stopped, the temperature was increased to 88° C. to cause the particles to coalesce. This temperature was maintained until the particles reached their desired circularity (about 0.97). The toner was then washed and dried.

The dried toner had a volume average particle size of 6.40 μm and a number average particle size of 5.18 μm. Fines (<2 μm) were present at 0.92% (by number) and the toner possessed a circularity of 0.970.

Example Toner D

A combination of Example Polyester Resin Emulsion A and an emulsion of ACT-004 polyester resin available from Toyobo Co., Ltd., Kita-ku, Osaka, Japan was used in a 70:30 ratio by weight to form the core and the shell of the toner, respectively. The ACT-004 polyester resin had a peak molecular weight of about 11,000, a glass transition temperature of about 57° C. to about 61° C., a melt temperature of about 104° C., and an acid value of about 16. The emulsion particle size was about 200 nm (volume average). The total polyester content represented about 87.9% of the total toner solids. Accordingly, Example Polyester Resin Emulsion A contained 61.5% of the total toner solids and the ACT-004 polyester emulsion contained 26.4% of the total toner solids. Components were added to a 2.5 liter reactor in the following percentages: Example Polyester Resin Emulsion A having 61.5 parts (polyester by weight), 6.8 parts (pigment by weight) of the Example Magenta Pigment Dispersion and 5 parts (release agent by weight) of the Example Wax Emulsion. Deionized water was then added so that the mixture contained about 12% to about 15% solids by weight.

The mixture was heated in the reactor to 30° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 200 g of 1% sulfuric acid solution. The flow of the loop was then reversed to return the toner mixture to the reactor and the temperature of the reactor was increased to about 35-40° C. Once the particle size reached 4.0 μm (number average), 5% (wt.) borax solution (15 g of solution having 0.75 g of borax) was added. The borax content represented about 0.25% by weight of the total toner solids. After the addition of borax, the ACT-004 polyester resin emulsion was added, which contained 26.4 parts (polyester by weight). The mixture was stirred for about 5 minutes and the pH was monitored. Once the particle size reached 5.5 μm (number average), 4% NaOH was added to raise the pH to about 6.20 to stop the particle growth. The reaction temperature was held for one hour. The particle size was monitored during this time period. Once particle growth stopped, the temperature was increased to 88° C. to cause the particles to coalesce. This temperature was maintained until the particles reached their desired circularity (about 0.97). The toner was then washed and dried.

The dried toner had a volume average particle size of 6.18 μm and a number average particle size of 5.28 μm. Fines (<2 μm) were present at 0.42% (by number) and the toner possessed a circularity of 0.973.

Example Toner E

The Example Polyester Resin Emulsion B was divided into two batches, split 70:30 by weight to form the core and the shell of the toner, respectively. The total polyester content represented about 87.9% of the total toner solids. Accordingly, the first batch contained 61.5% of the total toner solids and the second batch contained 26.4% of the total toner solids. Components were added to a 2.5 liter reactor in the following percentages: the first batch of Example Polyester Resin Emulsion B having 61.5 parts (polyester by weight), 6.8 parts (pigment by weight) of the Example Magenta Pigment Dispersion, and 5 parts (release agent by weight) of the Example Wax Emulsion. Deionized water was then added so that the mixture contained about 12% to about 15% solids by weight.

The mixture was heated in the reactor to 30° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 200 g of 1% sulfuric acid solution. The flow of the loop was then reversed to return the toner mixture to the reactor and the temperature of the reactor was increased to about 40-45° C. Once the particle size reached 5.0 μm (number average), 5% (wt.) borax solution (15 g of solution having 0.75 g of borax) was added. The borax content represented about 0.25% by weight of the total toner solids. After the addition of borax, the second batch of Example Polyester Resin Emulsion B was added, which contained 26.4 parts (polyester by weight). The mixture was stirred for about 5 minutes and the pH was monitored. Once the particle size reached 5.5 μm (number average), 4% NaOH was added to raise the pH to about 7.10 to stop the particle growth. The reaction temperature was held for one hour. The particle size was monitored during this time period. Once particle growth stopped, the temperature was increased to 88° C. to cause the particles to coalesce. This temperature was maintained until the particles reached their desired circularity (about 0.97). The toner was then washed and dried.

The dried toner had a volume average particle size of 7.24 μm and a number average particle size of 5.86 μm. Fines (<2 μm) were present at 1.76% (by number) and the toner possessed a circularity of 0.974.

Accordingly, it can be seen that the emulsion aggregation process used to prepare Example Toners A thru E, which included a borax coupling agent between core and shell layers of the toner particles, significantly reduced the percentage of fine particles in comparison with the conventional emulsion aggregation process used to prepare Comparative Example Toner I. Further, Example Toners A thru E each exhibit a comparable average particle size and circularity relative to Comparative Example Toner I as desired.

TEST RESULTS

Surface Migration

Figure 2:
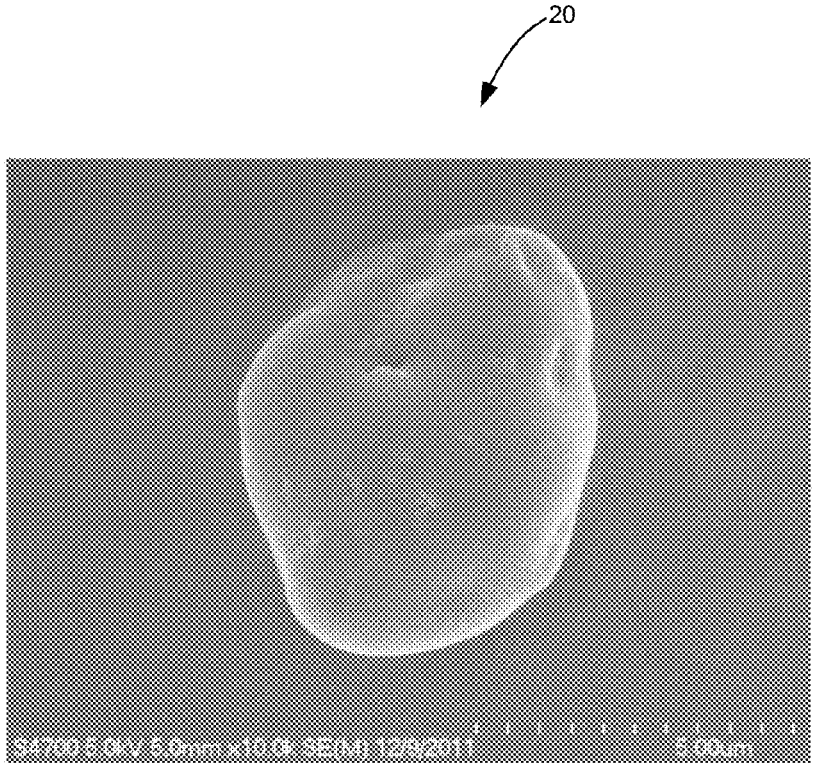
FIG. 2 is an image of an emulsion aggregation toner particle that includes a borax coupling agent between core and shell layers of the toner according to one example embodiment.

FIG. 1 shows an image of a conventional emulsion aggregation toner particle 10 prepared according to Comparative Example I taken using a scanning electron microscope (SEM). FIG. 2 shows an image of an emulsion aggregation toner particle 20 prepared according to Example A that includes a borax coupling agent between the core and shell layers of the toner. As illustrated, toner particle 20 has a smoother, more uniform surface than conventional emulsion aggregation toner particle 10. The smooth, uniform surface of toner particle 20 reduces the occurrence of filming on the developer roller and improves the toner's fusing performance at higher temperatures. In contrast, toner particle 10 has significantly more colorant, release agent and low molecular weight resin particles 12 that have migrated to its surface. As discussed above, borax surprisingly causes these particles to collect on the toner core before the shell layer is added, which prevents them from migrating to the toner surface.

Developer Roller and Doctor Blade Filming

The developer roller and doctor blade filming of Example Trs A and B and Comparative Example Toner I were also tested. The toners were each placed in a toner cartridge. Each cartridge was then inserted into a testing robot and run at 50 ppm. Periodically, each cartridge's developer roller and doctor blade were visually examined to assess the amount of toner filming on the components. The level of toner filming was graded on a scale of 1 to 4, where a higher grade (e.g., 4) indicates more filming and poorer performance. The testing results are shown in Table 1 below.

TABLE 1

| | Developer Roll Filming | | | Doctor Blade Filming | | |
|---|---|---|---|---|---|---|
| No. of Pages | Comparative Ex. Toner I | Toner A | Toner B | Comparative Ex. Toner I | Toner A | Toner B |
| 0 | 0 | 0 | 0 | 0 | 0 | 0 |
| 500 | 1 | 0 | 1 | 0 | 0 | 0 |
| 1,000 | 2 | 1 | 1 | 0 | 0 | 0 |
| 1,500 | 2 | 1 | 1 | 0 | 0 | 0 |
| 2,000 | 3 | 2 | 1 | 0 | 1 | 1 |
| 3,000 | 3 | 3 | 3 | 1 | 1 | 3 |
| 4,000 | 3 | 4 | 4 | 2 | 2 | 3 |
| 5,000 | 4 | — | — | 2 | — | — |

As shown in Table 1, Example Toners A and B, which included a borax coupling agent, exhibited improved resistance to developer roll filming and comparable resistance to doctor blade filming in comparison with Comparative Example Toner I.

In order to further evaluate the performance of the borax coupling agent, additional comparative example toners were prepared using a zinc sulfate and an aluminum sulfate coupling agent, respectively, between core and shell layers of the toner.

Comparative Example Toner II

Comparative Example Toner II was prepared using a zinc sulfate coupling agent instead of a borax coupling agent. The Example Polyester Resin Emulsion A was divided into two batches, split 70:30 by weight to form the core and the shell of the toner, respectively. The total polyester content represented about 90.3% of the total toner solids. Accordingly, the first batch contained 63.2% of the total toner solids and the second batch contained 27.1% of the total toner solids. Components were added to a 2.5 liter reactor in the following percentages: the first batch of the Example Polyester Resin Emulsion A having 63.2 parts (polyester by weight), 4.4 parts (pigment by weight) of the Example Cyan Pigment Dispersion, and 5 parts (release agent by weight) of the Example Wax Emulsion. Deionized water was then added so that the mixture contained about 12% to about 15% solids by weight.

The mixture was heated in the reactor to 30° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 175 g of 1% sulfuric acid solution. The flow of the loop was then reversed to return the toner mixture to the reactor and the temperature of the reactor was increased to about 40-45° C. Once the particle size reached 4.0 μm (number average), 5% (wt.) zinc sulfate solution (18 g of solution having 0.9 g of zinc sulfate) was added. The zinc sulfate content represented about 0.3% by weight of the total toner solids. After the addition of zinc sulfate, the second batch of the Example Polyester Resin Emulsion A was added, which contained 27.1 parts (polyester by weight). The mixture was stirred for about 5 minutes and the pH was monitored. Once the particle size reached 5.5 μm (number average), 4% NaOH was added to raise the pH to about 6.82 to stop the particle growth. The reaction temperature was held for one hour. The particle size was monitored during this time period. Once particle growth stopped, the temperature was increased to 88° C. to cause the particles to coalesce. This temperature was maintained until the particles reached their desired circularity (about 0.97). The toner was then washed and dried.

The dried toner had a volume average particle size of 5.87 μm and a number average particle size of 4.98 μm. Fines (<2 μm) were present at 1.12% (by number) and the toner possessed a circularity of 0.972.

Additional toners were made using the formulation and procedure from the Comparative Example Toner II, except the neutralization pH was altered to test the pH adjusting window. The results of these toners are shown in Table 2 below.

Comparative Example Toner III

Comparative Example Toner III was prepared using an aluminum sulfate coupling agent instead of a borax coupling agent. The Example Polyester Resin Emulsion A was divided into two batches, split 70:30 by weight to form the core and the shell of the toner, respectively. The total polyester content represented about 90.3% of the total toner solids. Accordingly, the first batch contained 63.2% of the total toner solids and the second batch contained 27.1% of the total toner solids. Components were added to a 2.5 liter reactor in the following percentages: the first batch of the Example Polyester Resin Emulsion A having 63.2 parts (polyester by weight), 4.4 parts (pigment by weight) of the Example Cyan Pigment Dispersion, and 5 parts (release agent by weight) of the Example Wax Emulsion. Deionized water was then added so that the mixture contained about 12% to about 15% solids by weight.

The mixture was heated in the reactor to 30° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 175 g of 1% sulfuric acid solution. The flow of the loop was then reversed to return the toner mixture to the reactor and the temperature of the reactor was increased to about 40-45° C. Once the particle size reached 4.0 μm (number average), 5% (wt.) aluminum sulfate solution (18 g of solution having 0.9 g of aluminum sulfate) was added. The aluminum sulfate content represented about 0.3% by weight of the total toner solids. After the addition of aluminum sulfate, the second batch of the Example Polyester Resin Emulsion A was added, which contained 27.1 parts (polyester by weight). The mixture was stirred for about 5 minutes and the pH was monitored. Once the particle size reached 5.5 μm (number average), 4% NaOH was added to raise the pH to about 6.47 to stop the particle growth. The reaction temperature was held for one hour. The particle size was monitored during this time period. Once particle growth stopped, the temperature was increased to 88° C. to cause the particles to coalesce. This temperature was maintained until the particles reached their desired circularity (about 0.97). The toner was then washed and dried.

The dried toner had a volume average particle size of 6.10 μm and a number average particle size of 5.20 μm. Fines (<2 μm) were present at 0.24% (by number) and the toner possessed a circularity of 0.970.

Additional toners were made using the formulation and procedure from the Comparative Example Toner III, except the neutralization pH was altered to test the pH adjusting window. The results of these toners are shown in Table 2 below.

pH Adjusting Window

Figure 3:
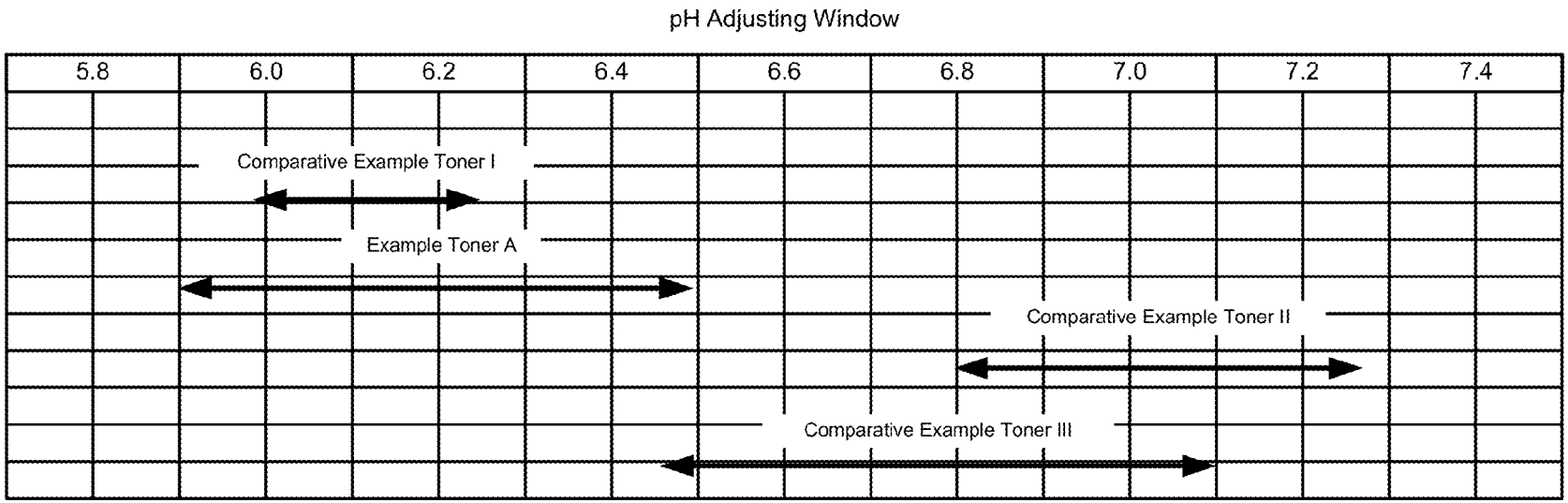
FIG. 3 is a graph depicting the pH adjusting windows for an emulsion aggregation toner that includes a borax coupling agent between core and shell layers of the toner according to one example embodiment compared to a conventional emulsion aggregation toner, a toner that includes a zinc sulfate coupling agent and a toner that includes an aluminum sulfate coupling agent.

The results of the pH adjusting window testing referred to above for Comparative Example Toners I-III and Example Toner A are shown in FIG. 3 and Table 2 below. Specifically, FIG. 3 shows a graph summarizing the data presented in Table 2.

TABLE 2

| Toner | Coupling Agent | pH | Volume Avg. Particle Size (μm) | Fines (% < 2 μm) | Accept-able? |
|---|---|---|---|---|---|
| Comp. Ex. Toner I | None | 5.97 | 7.43 | 0.9 | Marginal |
| Comp. Ex. Toner I | | 6.01 | 6.02 | 2.04 | Yes |
| Comp. Ex. Toner I | | 6.13 | 6.32 | 0.67 | Yes |
| Comp. Ex. Toner I | | 6.25 | 6.07 | 1.1 | Yes |
| Comp. Ex. Toner I | | 6.28 | 6.49 | 10.26 | No |
| Comp. Ex. Toner I | | 6.33 | 5.51 | 35.5 | No |
| Example Toner A | Borax | 5.77 | 7.51 | 0.28 | Marginal |
| Example Toner A | | 5.86 | 6.9 | 0.53 | Yes |
| Example Toner A | | 5.97 | 6.54 | 0.45 | Yes |
| Example Toner A | | 6.24 | 6.17 | 3.04 | Yes |
| Example Toner A | | 6.44 | 5.83 | 4.2 | Yes |
| Example Toner A | | 6.53 | 5.33 | 7.46 | Marginal |
| Comp. Ex. Toner II | Zinc | 6.5 | 7.67 | 0.22 | Marginal |
| Comp. Ex. Toner II | Sulfate | 6.59 | 7.38 | 0.29 | Marginal |
| Comp. Ex. Toner II | | 6.82 | 5.87 | 1.1 | Yes |
| Comp. Ex. Toner II | | 7.24 | 5.77 | 4.38 | Yes |
| Comp. Ex. Toner II | | 7.29 | 5.82 | 5.21 | Marginal |
| Comp. Ex. Toner III | Aluminum | 6.26 | 8.23 | 0.26 | No |
| Comp. Ex. Toner III | Sulfate | 6.31 | 7.16 | 0.54 | Marginal |
| Comp. Ex. Toner III | | 6.47 | 6.10 | 0.24 | Yes |
| Comp. Ex. Toner III | | 6.61 | 5.52 | 4.16 | Yes |
| Comp. Ex. Toner III | | 7.03 | 5.40 | 3.05 | Yes |
| Comp. Ex. Toner III | | 7.23 | 4.83 | 36.47 | No |

As illustrated in Table 2 and FIG. 3, the pH adjusting window for the toners having a coupling agent (borax, zinc sulfate or aluminum sulfate) are significantly broader than the pH adjusting window for the conventional emulsion aggregation toner of Comparative Example Toner I. As discussed above, when the pH adjusting window is broader, the process is easier to control at an industrial scale.

Fusing Window

Each toner composition was used to print 24# Hammermill laser paper (HMLP) using a fusing robot at 50 pages per minute (ppm) with a toner coverage of 1.1 mg/cm$^2$ employing various fusing temperatures as shown in Tables 3 and 4 below. The temperatures indicated in Tables 3 and 4 are the temperatures of the fusing robot's heating element/heater. For each toner composition, various fuse grade measurements were performed. These fuse grade measurements include a scratch resistance test shown in Table 3 and a conventional 60 degree gloss test shown in Table 4. For the scratch resistance test, the printed samples were evaluated using a TABER ABRADER device from TABER Industries, North Tonawanda, N.Y., USA. The printed samples were evaluated on the TABER ABRADER scale from 0 to 10 (where a rating of 10 indicates the most scratch resistance). The TABER ABRADER device scratches the printed samples multiple times with different forces until the toner is scratched off the sample. The point at which the toner is scratched off corresponds with a number rating between 0 and 10 on the TABER ABRADER scale. As is known in the art, the conventional 60 degree gloss test includes shining a known amount of light at the surface of the printed sheet at a 60 degree angle and measuring its reflectance. A higher gloss test value indicates that more energy was transferred to the substrate when it moved through the fuser. The gloss of the print also relates to the resin and release agent used in the toner.

TABLE 3

Scratch Test

| Fusing Temp. (° C.) | Comp. Toner I | Toner A | Toner B | Toner C | Toner D | Toner E | Comp. Toner II | Comp. Toner III |
|---|---|---|---|---|---|---|---|---|
| 190 | — | CO | CO | CO | CO | — | — | — |
| 195 | — | 4 | 6.7 | 9 | 3.7 | — | — | — |
| 200 | CO | 5.5 | 7.7 | 10 | 10 | CO | — | — |
| 205 | CO | 8.7 | 9.7 | 10 | 10 | 4 | CO | CO |
| 210 | 6 | 10 | 10 | 10 | 10 | 9.7 | 2.3 | 5.3 |
| 215 | 8 | 10 | 10 | 10 | 10 | 10 | 4 | 9.7 |
| 220 | 8.3 | 10 | 10 | 10 | 10 | 10 | 10 | 9.7 |
| 225 | 9 | 10 | 10 | 10 | 10 | 10 | 7.3 | 9.7 |
| 230 | 10 | 10 | 10 | 10 | 10 | 10 | 10 | 10 |

TABLE 4

Gloss Test

| Fusing Temp. (° C.) | Comp. Toner I | Toner A | Toner B | Toner C | Toner D | Toner E | Comp. Toner II | Comp. Toner III |
|---|---|---|---|---|---|---|---|---|
| 190 | — | — | — | — | — | — | — | — |
| 195 | — | — | 5.9 | 6.5 | 9.3 | — | — | — |
| 200 | — | 6.4 | 6.8 | 9.1 | 10.4 | — | — | — |
| 205 | — | 7.9 | 7.8 | 9.1 | 10.7 | — | — | — |
| 210 | 8.8 | 8.3 | 8.5 | 10.4 | 11.5 | 10.1 | — | 4.3 |
| 215 | 9.2 | 9 | 10.5 | 13 | 13.1 | 12 | — | 4.9 |
| 220 | 11.2 | 10.2 | 11.5 | 14.1 | 14.9 | 13.4 | 7.7 | 5 |
| 225 | 10.7 | 10.9 | 12.6 | 14.3 | 16 | 14 | 9.2 | 6.1 |
| 230 | 12.8 | 12.1 | 12.1 | 16.9 | 16.8 | 16.7 | 10.4 | 6.3 |

As shown in Table 3, Example Toners A and B, which included a borax coupling agent and were formed using the same resin as Comparative Example Toners I-III, exhibited superior fusing performance compared to the conventional emulsion aggregation toner (Comparative Example Toner I) and the toners having a zinc sulfate or an aluminum sulfate coupling agent (Comparative Example Toners II and III). The low ends of the fusing windows for Example Toners A and B were lower than the low ends of the fusing windows for Comparative Examples I-III. Specifically, Example Toners A and B provided acceptable scratch resistance at temperatures as low as 200° C. and 195° C., respectively. Comparative Example Toners I-III were unable to provide acceptable scratch resistance at these temperatures and instead showed cold offset ("CO"), which means the toner failed to fuse to the paper. Accordingly, less energy was required to accomplish an acceptable fusing operation for Example Toners A and B than for Comparative Example Toners I-III. Example Toners A and B also provided improved scratch resistance at elevated temperatures from 210° C.-230° C. in comparison with Comparative Example Toners I-III.

The cores of Example Toners C and D were formed using the same resin as Example Toners A and B and Comparative Example Toners I-III but different resins were used to form the shells of Example Toners C and D. Nonetheless, as shown in Table 3, the low ends of the fusing windows for Example Toners C and D, which included a borax coupling agent, were lower than the low ends of the fusing windows for Comparative Examples I-III. Example Toners C and D also exhibited improved scratch resistance at elevated temperatures from 210° C.-230° C. in comparison with Comparative Example Toners I-III.

Example Toner E was formed using a higher molecular weight resin having a higher glass transition temperature than the resin used to form Example Toners A and B and Comparative Example Toners I-III. It will be appreciated by one skilled in the art that the higher molecular weight and the higher glass transition temperature of this resin were expected to compromise the low end of the fusing window. Table 3 shows that Example Toners A and B outperformed Example Toner E due to the lower molecular weight and lower glass transition temperature resin used in Example Toners A and B. However, the fusing performance of Example Toner E, which included a borax coupling agent and a higher molecular weight and higher glass transition temperature resin, was comparable to the fusing performance of Comparative Example Toners I-III even though Comparative Example Toners I-III included a lower molecular weight and lower glass transition temperature resin.

As shown in Table 4, Example Toners A thru E exhibited comparable gloss test performance in comparison with the Comparative Example Toner I. Comparative Example Toners II and III showed poorer gloss values in comparison with Example Toners A thru E and Comparative Example Toner I.

The foregoing description of several embodiments has been presented for purposes of illustration. It is not intended to be exhaustive or to limit the application to the precise forms disclosed, and obviously many modifications and variations are possible in light of the above teaching. It is understood that the invention may be practiced in ways other than as specifically set forth herein without departing from the scope of the invention. It is intended that the scope of the application be defined by the claims appended hereto.

What is claimed is:

1. A method for producing toner, comprising:

combining and agglomerating a first polymer emulsion with a colorant dispersion and a release agent dispersion to form toner cores;

adding a borax coupling agent to the toner cores;

combining and agglomerating a second polymer emulsion with the toner cores having the borax coupling agent to form toner shells around the toner cores; and fusing the aggregated toner cores and toner shells to form toner particles.

2. The method of claim 1, wherein the borax coupling agent is added to the toner cores once the toner cores reach a predetermined size.

3. The method of claim 1, wherein the coupling agent is added at between about 0.1% and about 5.0% by weight of the total polymer binder content in the first polymer emulsion and the second polymer emulsion.

4. The method of claim 3, wherein the coupling agent is added at between about 0.1% and about 1.0% by weight of the total polymer binder content in the first polymer emulsion and the second polymer emulsion.

5. The method of claim 1, wherein the first polymer emulsion and the second polymer emulsion each include a polyester resin.

6. The method of claim 5, wherein the first polymer emulsion includes a first polyester resin or mixture and the second polymer emulsion includes a second polyester resin or mixture different from the first polyester resin or mixture.

7. The method of claim 1, wherein the first polymer emulsion and the second polymer emulsion each include a styrene polymer.

8. The method of claim 7, wherein the first polymer emulsion includes a first styrene polymer or mixture and the second polymer emulsion includes a second styrene polymer or mixture different from the first styrene polymer or mixture.

9. The method of claim 1, wherein the ratio of polymer binder present in the first polymer emulsion to polymer binder present in the second polymer emulsion is between about 20:80 (wt.) and about 80:20 (wt.).

10. The method of claim 9, wherein the ratio of polymer binder present in the first polymer emulsion to polymer binder present in the second polymer emulsion is between about 50:50 (wt.) and about 80:20 (wt.).

11. The method claim 1, wherein the first polymer emulsion and the second polymer emulsion include the same polymer binder.

12. A toner prepared by the process of claim 1.

13. A method for producing toner, comprising:

combining as first polymer emulsion with a colorant dispersion and a release agent dispersion to form toner cores;

adjusting the pH of the combination of the first polymer emulsion, the colorant dispersion and the release agent dispersion to promote agglomeration of the toner cores;

once the toner cores reach a predetermined size, adding a borax coupling agent to the toner cores;

combining a second polymer emulsion with the toner cores having the borax coupling agent and forming toner shells around the toner cores;

once a desired toner particle size is reached, adjusting the pH of the mixture of aggregated toner cores and toner shells to prevent additional particle growth; and fusing the aggregated toner cores and toner shells to form toner particles.

14. The method of claim 13, wherein the coupling agent is added at between about 0.1% and about 1.0% by weight of the total polymer binder content in the first polymer emulsion and the second polymer emulsion.

15. The method of claim 13, wherein the first polymer emulsion and the second polymer emulsion each include a polyester resin.

16. The method of claim 13, wherein the first polymer emulsion includes a first polyester resin or mixture and the second polymer emulsion includes a second polyester resin or mixture different from the first polyester resin or mixture.

17. The method of claim 13, wherein the first polymer emulsion and the second polymer emulsion each include a styrene polymer.

18. The method of claim 13, wherein the first polymer emulsion includes a first styrene polymer or mixture and the second polymer emulsion includes a second styrene polymer or mixture different from the first styrene polymer or mixture.

19. The method of claim 13, wherein the ratio of polymer hinder present in the first polymer emulsion to polymer binder present in the second polymer emulsion is between about 50:50 (wt.) and about 80:20 (wt.).

20. The method claim 13, wherein the first polymer emulsion and the second polymer emulsion include the same polymer hinder.

* * * * *